United States Patent [19]

Den Bleyker

[11] Patent Number: 4,992,081

[45] Date of Patent: Feb. 12, 1991

[54] REACTOR DIP TUBE COOLING SYSTEM

[75] Inventor: Alfred L. Den Bleyker, Houston, Tex.

[73] Assignee: Texaco Inc., White Plains, N.Y.

[21] Appl. No.: 407,977

[22] Filed: Sep. 15, 1989

[51] Int. Cl.[5] ..... C10J 3/82

[52] U.S. Cl. ..... 48/69; 48/87; 48/DIG. 2; 261/112.1

[58] Field of Search ..... 48/69, 87, DIG. 2; 422/207; 261/112.1, 121.1; 55/256

[56] References Cited

U.S. PATENT DOCUMENTS 4,444,726 4/1984 Crotty et al. ..... 422/207

*Primary Examiner*—Joye L. Woodard

*Attorney, Agent, or Firm*—Robert A. Kulason; James J. O'Loughlin; Robert B. Burns

[57] ABSTRACT

In a gasification reactor having a shell, a combustion chamber in the shell, and a burner positioned to direct a carbonaceous fuel mixture into the combustion chamber. A quench chamber within the shell holds a cooling bath into which the hot effluent resulting from the combustion is cooled. A throat communicating the combustion chamber with the quench chamber guides the hot effluent stream toward the bath. A quench ring including a receptacle rim, is positioned beneath the throat to support a water jacketed dip tube which guides the hot effluent into contact with the bath liquid. Liquid coolant is conducted into the water jacket by way of connectable flow passages formed into the rim and the dip tube assembly, and thereafter discharged against the dip tube.

1 Claim, 3 Drawing Sheets

REACTOR DIP TUBE COOLING SYSTEM

BACKGROUND OF THE INVENTION

In the production of a usable synthesis gas by the combustion of a carbonaceous fuel, the process is operated most effectively in a gasifier or reactor under high temperature and high pressure conditions. For example, for the efficient production of a synthesis gas from a particulated coal or coke, a preferred operating temperature range of about 2400° to 2600° F. is maintained, at a pressure of between about 5 to 250 atmospheres.

The harsh operating conditions prevalent in such a process, and in particular the wide temperature variations experienced, imposes a severe strain on many segments of the gasifier. This type of reactor unit is normally furnished with thermal insulation as well as with a system to cool interior parts. Usually such parts as the dip tube that contacts hot effluent gases, require adequate cooling if the usable life of this member is to be preserved.

The invention is addressed to an improvement in the structure of a gasifier, and particularly in the gasifier's quench ring and cooling water distribution system. The latter, by its inherent function, is exposed to maximum temperature conditions and destructive gases. Damage often results by virtue of hot synthesis gas, which comes in direct contact with the quench ring as the hot effluent passes from the reactor's combustion chamber, into a cooling or quenching zone.

In one embodiment of a reactor structure, the combustion chamber within the reactor shell is lined with a refractory material to avoid thermal damage to the metallic shell. This refractory material can take the form of individual bricks or it can be in the configuration of a unitary member shaped of a castable refractory material. In either instance, the refractory blocks are combined and contoured to define the gasifier's constricted throat.

The refractory throat section communicated with the combustion chamber, is as a practical matter, supported in a way that throat segments can be removed if required for repair or replacement. One form of support resides in placing the quench ring in such position that it will support the throat from the underside. Thus, the quench ring, which is supportably fastened to the shell wall, will locate the throat.

However, during an operational shut down, it is probable that in the course of cooling, metallic segments of the gasifier such as the quench ring and its auxiliary parts will cool rapidly. This will allow quick access to the reactor interior for performing necessary repair or maintenance work.

When, however, the reactor's quench ring requires removal from the gasifier for repair or replacement, it is necessary to first detach the refractory blocks which make up the constricted throat. These non-metallic members require a considerably longer time period to cool than does the metallic quench ring.

Ordinarily several days might elapse before one can obtain safe access to the reactor interior to permit removal of the quench ring. Furthermore, removal of the throat refractory necessitates the expense of its subsequent replacement. This follows, since used fire brick, once disturbed, cannot be correctly reassembled.

In the instance of the gasifier metallic dip tube, this member experiences the most severe operating conditions. Even though the dip tube inner or guide surface is wetted by a coolant stream, the dip tube remains subject to thermal damage after a period of time. This results not only from the contact with the hot flowing gas along the dip tube surface, but also due to thermal stresses which develop in the metal.

DISCUSSION OF THE PRIOR ART

The prior art has disclosed various ways and means for preserving dip tube integrity, most of which rely on cooling by contacting the dip tube with water. For example, U.S. Pat. No. 4,444,726, Crotty et al, discloses a gasifier of the type presently contemplated in which a dip tube is water cooled. In this arrangement, the quench ring is positioned along the dip tube assembly and therefore requires additional heat shielding. The latter takes the form of a circular insulating ring.

Generally, cooling of the dip tube is effectuated by delivering a stream of water across the dip tube exposed surface and by surrounding the dip tube with a jacket. This arrangement, however, necessitates an external water connection between the quench ring to the jacket. An arrangement of this type is illustrated in U.S. Pat. No. 4,902,303.

In the presently proposed arrangement the dip tube means is comprised of a separable unit, and carries a water stream which is discharged against the exposed dip tube face. Further, the dip tube includes a water jacket at its rear or non-exposed side. This structure constitutes an effective advance in the known prior art by preserving the dip tube life.

A further feature toward overcoming expected operating problems, and to minimize gasifier down time and throat replacement, the present invention embodies an improvement in gasifier structure. Particularly in the constricted throat between combustion chamber and quench chamber which is formed of one or more refractory blocks.

The latter are supported in place by a quench ring having separable sections. Thus, when the exposed dip tube is damaged to the point of needing repair, it can be readily disconnected and separated from the quench ring receptacle without disturbing the quench ring itself. The latter remains in place supporting the refractory throat.

The water carrying dip tube assembly section which maintains a coolant stream against the dip tube exposed surface, is detachably fastened to the quench ring. In a preferred construction, and as hereafter disclosed, the respective dip tube assembly and quench ring are provided with a thermally resistant separating gasket to minimize the heat flow therebetween.

In terms of economics, the cooperative arrangement of the quench ring and the dip tube assembly, permits the latter to be completely removed while leaving the supporting quench ring in place. Shut down time of the gasifier can therefore be reduced by several days through use of the disclosed separable quench ring and dip tube assembly arrangement. Further, the improvement as herein disclosed resides in coolant flow to the dip tube assembly which is facilitated through a series of internal passages communicated with the quench ring.

It is therefore an object of the invention to provide an improved gasification reactor having a coolant jacketed dip tube assembly which is provided with means for carrying liquid coolant through internal passages.

A further object is to provide a dip tube assembly that is readily detachable from the quench ring water reservoir to facilitate access to the reactor's interior, yet is communicated internally with a said water reservoir.

DETAILED DESCRIPTION OF THE DRAWINGS

Figure 1:
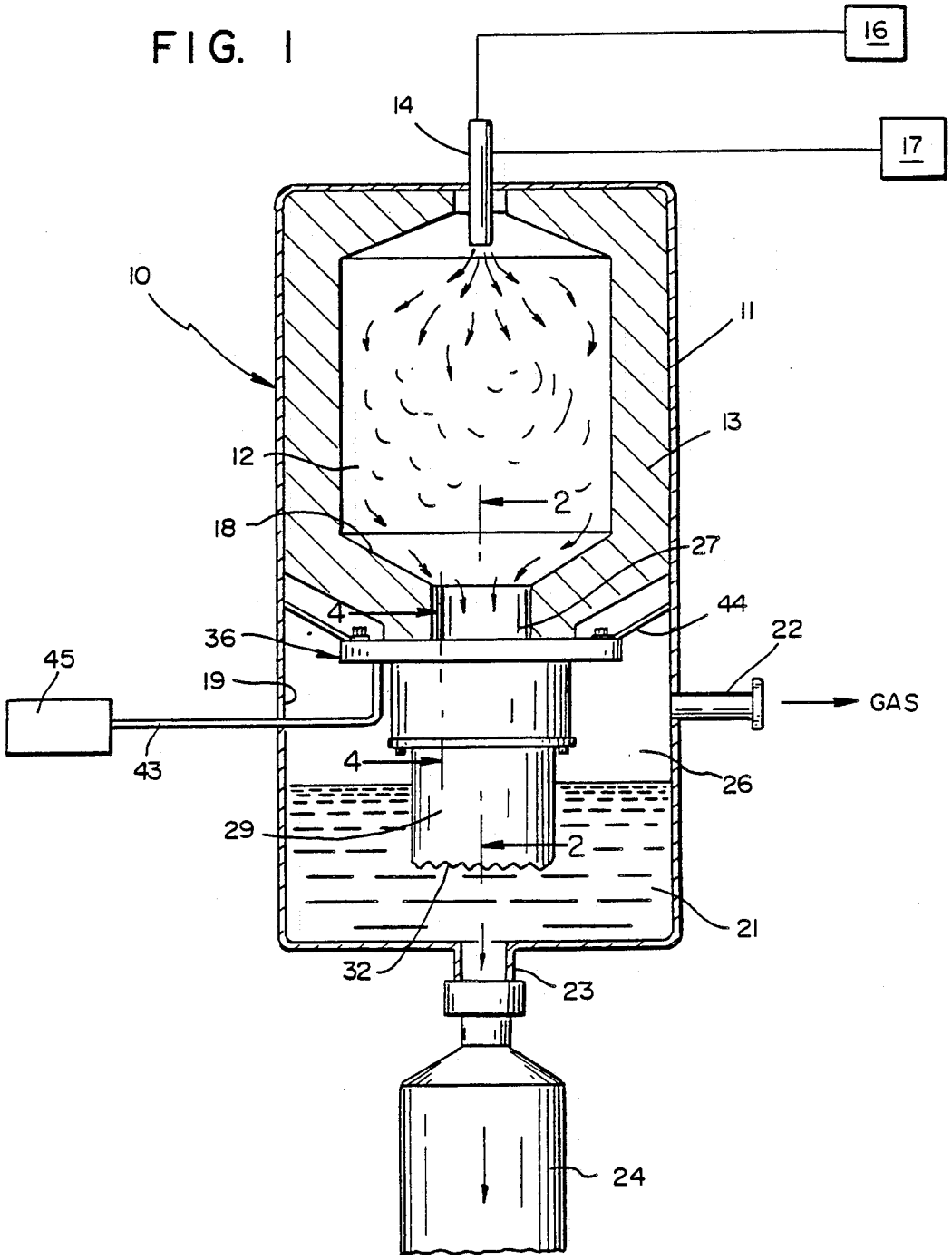
FIG. 1 is an elevation view in cross-section of a reactor of the type contemplated.

Referring now to FIG. 1, a gasifier or reactor 10 of the type contemplated embodies an elongated metallic steel walled shell 11. The shell normally functions in an upright position to permit a downflow of the hot effluent product. Shell 11 includes a reaction or combustion chamber 12 at the upper end. To withstand operating temperatures between 2,000° to 3,000 F., chamber 12 is provided with a lined inner wall 13, preferably formed of a refractory material.

A burner 14 is removably positioned at shell 11 upper wall to inject a carbonaceous fuel mixture such as particulated coal or coke from source 16, into combustion chamber 12. An amount of a combustion supporting gas from a pressurized source 17 is concurrently fed into burner 14 to form a desired fuel mixture.

The invention can be applied equally as well to gasifiers which burn a variety of carbonaceous solid, liquid, or gaseous fuels. To illustrate the instant embodiment, however, it will be assumed that burner 14 is communicated with a source 16 of coke. The latter is preferably preground and formed into a slurry of desired consistency by addition of a sufficient amount of water. The pressurized combustion supporting gas at source 17 is normally oxygen, air, or a mixture thereof.

The lower end of combustion chamber 12 is defined by a downwardly sloping refractory floor 18. This configuration enhances the discharge of hot gas and liquefied slag from said chamber 12.

The lower end of shell 11 includes a quench chamber 19 into which hot effluent comprised of the products of gasification are directed. Both solid and gaseous products contact liquid coolant bath 21, which is most conveniently comprised of circulating water. The cooled gas emerges from quench bath 21 into disengaging zone 26 before leaving the quench chamber through line 22.

Cooled, substantially particle free gas can now be processed in downstream equipment and operations, into a usable form. The solid or slag component of the effluent sinks through bath 21 to be removed by way of discharge port 23 into lockhopper 24.

Reaction chamber 12 and quench chamber 19 are communicated through constricted throat 27 formed in the reaction chamber floor 18. To achieve efficient contact of the hot effluent with liquid in bath 21, quench chamber 19 is provided with dip tube assembly 29. The latter includes an upper end positioned adjacent to constricted throat 27. Dip tube assembly 29 further includes a lower edge 32 which terminates in coolant bath 21 to define an effluent guide path along the dip tube inner surface 28.

Figure 2:
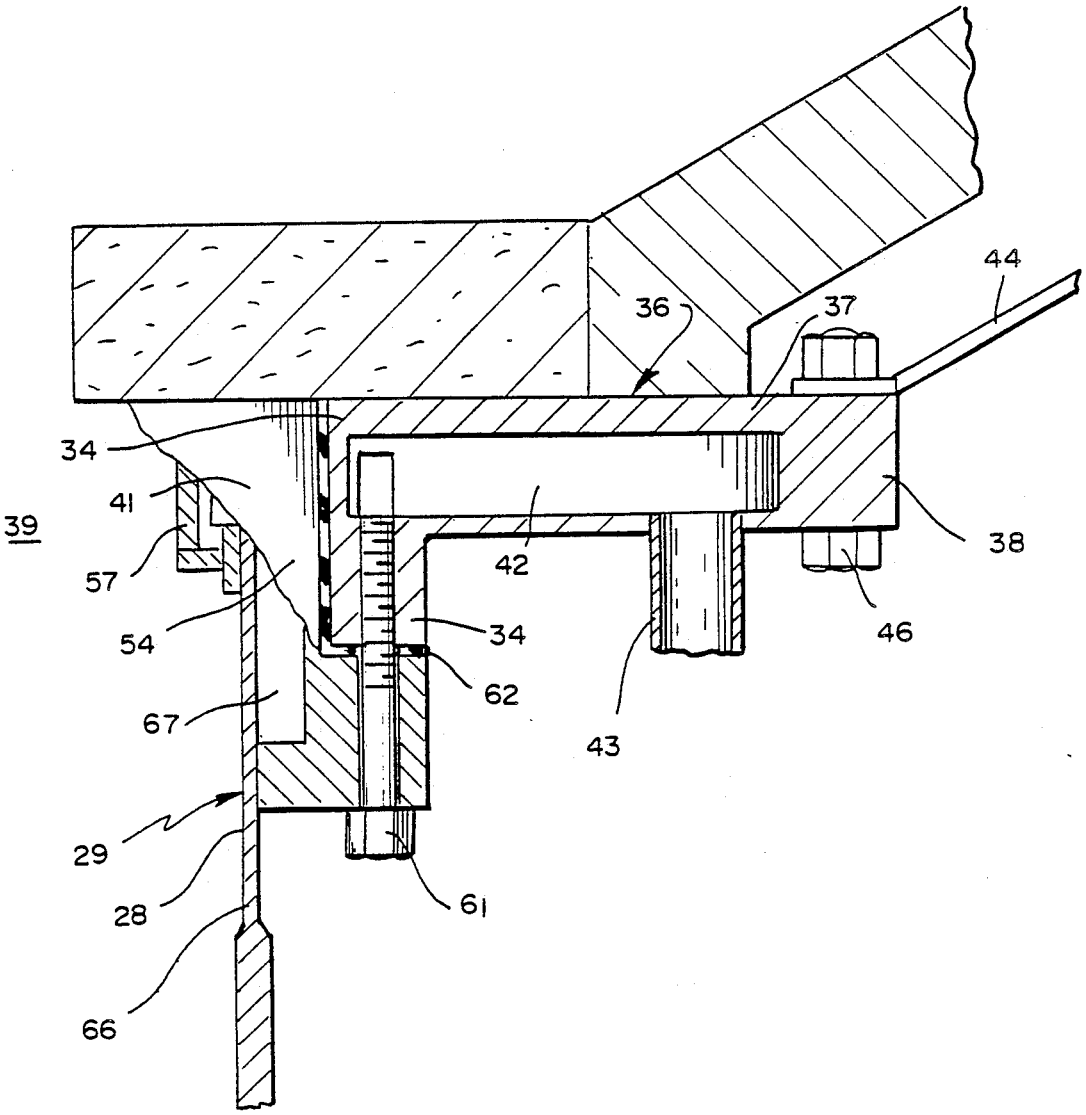
FIG. 2 is a cross-sectional view taken along line 2—2 of FIG. 1.
Figure 3:
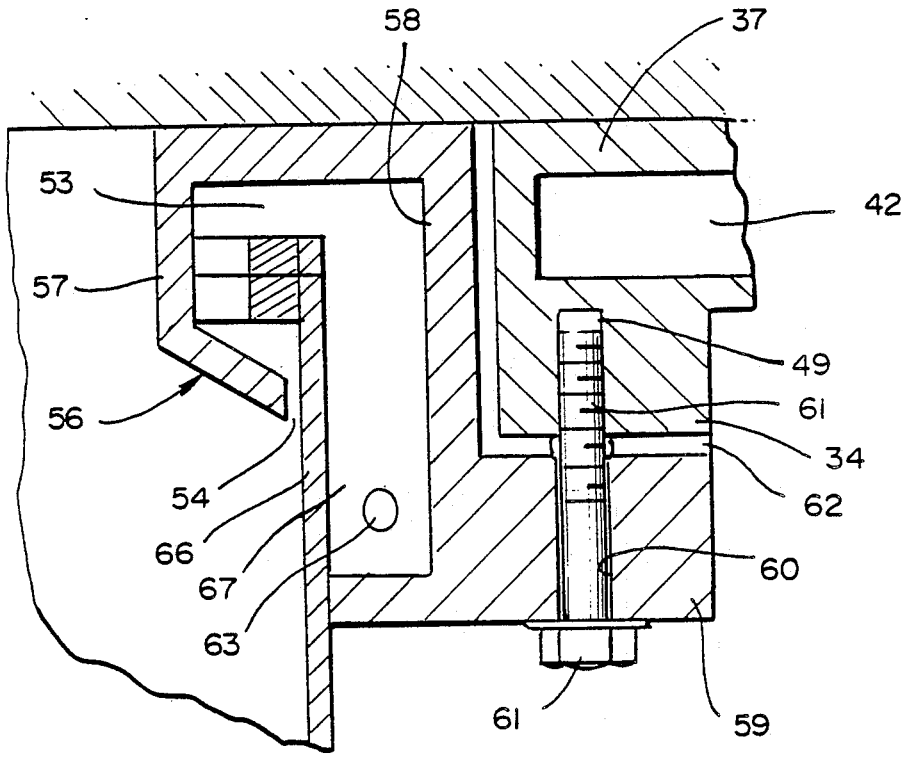
FIGS. 3 and 4 are segmentary cross sectional views of FIG. 2 on an enlarged scale.
Figure 4:
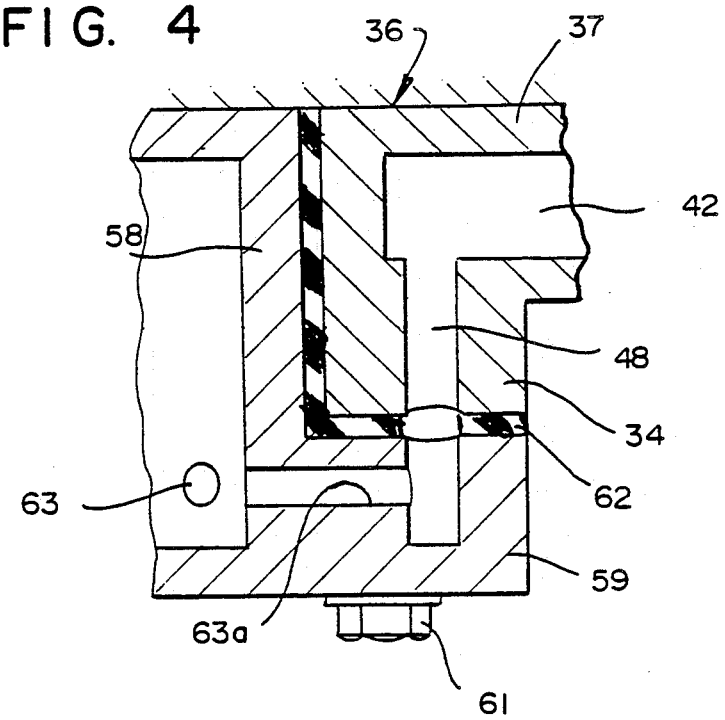

Referring to FIG. 2, 3 and 4 constricted throat 27 defines the initial passage through which high temperature, high pressure effluent is guided, prior to entering the effluent guide path defined by dip tube inner surface 28.

In one embodiment of the invention, quench ring 36 is comprised of a main toroidal ring or body 37 having a side wall 38 which defines the ring's outer periphery. A second or inner wall 39 includes a rim 34 which defines a downwardly opening, circular receptacle 41.

As shown in FIGS. 1 and 2, quench ring 36 includes a liquid circulating compartment or passage 42 communicated at its lower side with a pressurized source 45 of the cooling liquid by way of conduit 43. The coolant, as noted, is preferably water, maintained under a pressure in excess of the gasifier pressure. The upper wall of quench ring 36 as shown, is supportably engaged with a stiffener ring or bracket 44. A plurality of peripherally spaced fastening bolts and nuts 46 engage the two members. Stiffener ring 44 firmly positions the toroidal quench ring body 37 such that it forms a circular shelf or lower support element for the refractory which make up the constricted throat 27 and floor 18.

Rim 34 extends downwardly and terminates in a peripheral connecting flange. The latter includes a bolt circle having a series of bolt clearance holes 49 spaced to receive connecting bolts 61.

Referring to FIGS. 3 and 4, a plurality of circularly arranged flow passage means such as flow channels 48 are formed into rim 34 and communicated with liquid compartment 42. Functionally, flow channels 48 conduct pressurized streams of coolant through rim 34 for eventual discharge against the dip tube surface 28. As shown in FIG. 3, a series of bolt holes 49 is arranged alternately with the circularly arranged flow channels 48.

A dip tube assembly 56 detachably depends from quench ring 36 to permit ready access to, and removal of the dip tube for replacement or repair. Dip tube assembly 56 includes a second toroidal body 57 having an annular channel 53 through which coolant flows prior to being discharged by way of annular port 54, into bath 21.

Second toroidal body 57 includes a lateral wall 58 which is sized and contoured to register in receptacle 41. An outwardly extending flange 59 depends from wall 58 and is positioned to engage the face of rim 34. A series of circularly arranged bolt clearance holes 60 in flange 59 registers with corresponding bolt holes 49 in rim 34 which accommodate fastening bolts 61.

A flexible gasket 62 is compressibly retained between rim 34 and flange 59. Said flexible member, when properly compressed, will assure the water tight integrity of the connection between the two detachable quench ring 36 and dip tube assembly 56.

Flange 59 further includes a plurality of liquid connector passages 63 and 63A, the latter being aligned with flow channel 48 to receive coolant from compartment 42.

Dip tube 66 is fixedly positioned to second toroidal body 57, depending downwardly to guide hot effluent into water bath 21, as the effluent is discharged from constricted throat 27.

Annular liquid carrying channel 53 as shown, will normally urge coolant into contact with the inner wall of toroidal body 57 cooling the latter. Thereafter, the coolant, still under pressure, is discharged through annular port 54, against the exposed inner face 28 of dip tube 66.

Dip tube 66 is positioned on the second toroidal body 57, being spaced from lateral wall 58 to define an internal coolant circulating chamber or jacket 67. The latter extends for a sufficient length along dip tube 66 preferably to the lower end thereof to assure cooling through heat exchange.

It is understood that although modifications and variations of the invention can be made without departing from the spirit and scope thereof, only such limitations should be imposed as are indicated in the appended claims.

We claim:

1. In a gasification reactor for combusting a carbonaceous fuel mixture to produce a hot effluent stream comprised primarily of a usable gas, said reactor including:

an elongated shell (11), means forming a combustion chamber (12) in said shell, a burner (14) in said shell interconnected with a means for supplying a pressurized carbonaceous fuel and combustion supporting gas to discharge a mixture of the fuel and combustion support gas into combustion chamber (12), and produce a hot effluent stream therein means forming a quench chamber (19) in said shell (11) holding a liquid bath (21), effluent guide means communicated with said combustion chamber (12) for conducting said hot effluent stream therefrom, and into said bath held in the quench chamber, said effluent guide means comprising:

a quench ring (36) supportably positioned in said quench chamber (19) having a first toroidal body (37) including:

means forming an annular coolant compartment (42) interconnected with means for supplying pressurized liquid coolant (45), the improvement therein of:

an annular rim (34) depending from said first toroidal body (37) defining a downwardly facing cylindrical receptacle (41), flow channel means (48) in said annular rim (34) communicated with said annular coolant compartment (42), a dip tube assembly (56) removably engaging said quench ring (36) and including:

a second toroidal body (57) having a lateral wall (58) registered in said sealed engagement with said cylindrical receptacle (41), and having a flange (59) extending outwardly from said lateral wall, a dip tube (66) depending from said second toroidal body (57), having an exterior wall spaced from said lateral wall to define a liquid coolant circulating jacket (67) therebetween, liquid discharge port means (54) in said second toroidal body (57) in communication with said liquid coolant circulating jacket and aligned to direct liquid coolant against an interior wall of the dip tube which is exposed to the hot effluent stream, and flow passage means (63) in said flange (59), communicating said coolant circulating jacket (67) with said flow channel means (48).

* * * * *